United States Patent [19]

Marzoli

[11] Patent Number: 4,934,132

[45] Date of Patent: Jun. 19, 1990

[54] APPARATUS FOR DOFFING BOBBINS FROM ROVING FRAMES AND REPLACING THE DOFFED BOBBINS WITH EMPTY TUBES

[76] Inventor: Pietro B. Marzoli, Via Durante, 1--25036 Palazzolo Sull'Oglio (Brescia), Italy

[21] Appl. No.: 241,338

[22] Filed: Sep. 7, 1988

[30] Foreign Application Priority Data

Oct. 2, 1987 [IT] Italy ..... 22137 A/87

[51] Int. Cl.[5] ..... D01H 9/04

[52] U.S. Cl. ..... 57/267; 57/276

[58] Field of Search ..... 57/67, 70, 71, 266, 57/267, 276

[56] References Cited

U.S. PATENT DOCUMENTS 3,935,699 2/1976 Iida et al. ..... 57/267

4,389,840 6/1983 Briner et al. ..... 57/267

*Primary Examiner*—John Petrakes

*Attorney, Agent, or Firm*—Bucknam and Archer

[57] ABSTRACT

The apparatus comprises an endless upward and downward displaceable conveyor belt mounted on a horizontal frame and supporting a plurality of evenly spaced gripping devices, the apparatus further including a bobbin bearing carriage which can be longitudinally displaced so as to be alternatively arranged near the flyer bearing frame and near the conveyor belt.

4 Claims, 1 Drawing Sheet

APPARATUS FOR DOFFING BOBBINS FROM ROVING FRAMES AND REPLACING THE DOFFED BOBBINS WITH EMPTY TUBES

BACKGROUND OF THE INVENTION

The present invention relates to an apparatus for automatically doffing bobbins from roving frames and replacing the doffed bobbins with empty tubes.

As is known, the operation of doffing bobbins from roving frames and replacing the removed bobbins with empty tubes thereon the roving is to be wound, is generally carried out in a manual manner with a great amount of labour and a consequent poor efficiency of the roving frames.

Known semi-automatic doffing and replacing apparatus, on the other hand, are rather complex and of large size and do not carry out the mentioned operations in a completely automatic way.

SUMMARY OF THE INVENTION

Accordingly, the main object of the present invention is to overcome the above mentioned drawbacks by providing such an apparatus for automatically doffing roving bobbins from a roving frame and replacing the removed bobbins with empty tubes which is construction-wise very simple and reliable.

Another object of the present invention is to provide an apparatus for automatically doffing bobbins from a roving frame and replacing the doffed bobbins with empty tubes which comprises means for facilitating the repairing operations of broken rovings both during the bobbin forming step and during the formed bobbin doffing step.

Another object of the present invention is to provide such an apparatus for automatically doffing bobbins from a roving frame and replacing the doffed bobbins with empty tubes which has very reduced maintenence requirements and can be set for operations in a very simple way.

Still another object of the present invention is to provide such an apparatus for automatically doffing bobbins from a roving frame and replacing the doffed bobbins with empty tubes which reduces to a minimum the time required for doffing the bobbins, thereby improving efficiency.

According to one aspect of the present invention, the above mentioned objects, as well as yet other objects, which will become more apparent hereinafter, are achieved by an apparatus for doffing bobbins from a roving frame and replacing the doffed bobbins with empty tubes, characterized in that said apparatus comprises, essentially, an endless conveyor belt, mounted on a horizontal frame for downward and upward displacement, said apparatus further comprising a bobbin bearing carriage which can slide in parrallel to its longitudinal axis so as to be arranged on the vertical line of said conveyor belt, and driving means for controlling said apparatus.

BRIEF DESCRIPTION OF THE DRAWINGS

Further characteristics and advantages of the apparatus for automatically doffing bobbins from a roving frame and replacing the doffed bobbins with empty tubes, will become more apparent hereinafter from the following detailed description of a preferred embodiment thereof which is illustrated, by way of an indicative but not limitative example, in the accompanying drawing, in which.

DESCRIPTION OF THE PREFERRED EMBODIMENT

Figure 1:
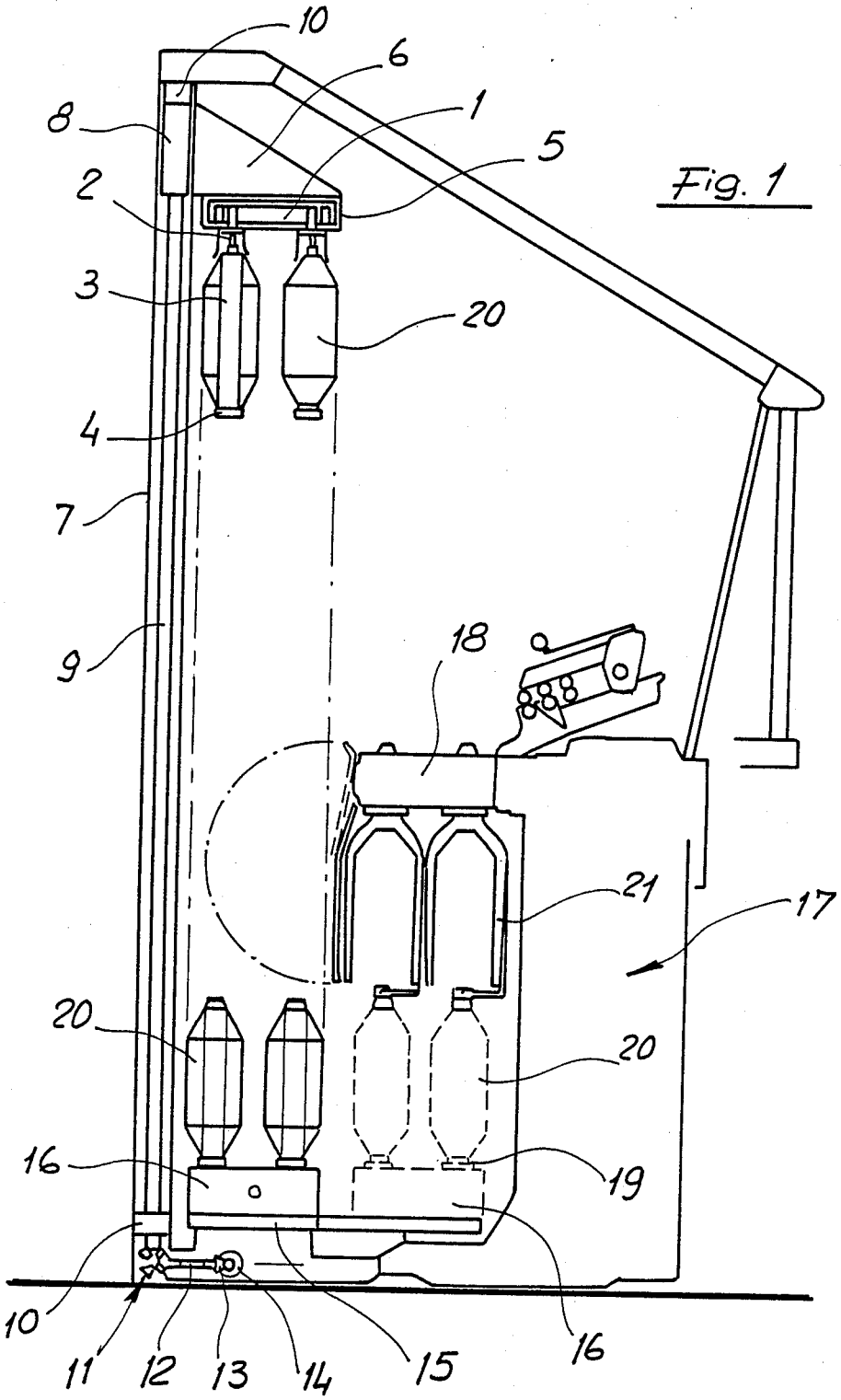
FIG. 1 is a schematic cross-sectional view illustrating the apparatus according to the present invention.

With reference to the drawing figure, the apparatus for automatically doffing bobbins from a roving frame and replacing the doffed bobbins with empty tubes according to the present invention comprises a conveyor belt, of the endless type, indicated at the reference number 1 and including two parallel legs the end portions of which are coupled by semicircular portions.

This conveyor belt 1 is provided, at even spacings, with gripping or engaging devices 2 having their axes downward turned and provied for gripping, from the inside, corresponding tube elements 3 having a respective bottom flange 4.

That same conveoyr belt 1, or bridge, is mounted on a respective frame 5 which is in turn supported by at least a pair of brackets 6 which slide together, upward and downward, on corresponding vertically extending guides 7.

More specifically the displacement of the mentioned brackets is preferably obtained by mounting said brackets on screw members 8 engaging with correspondingly threaded uprights 9 supported on end supporting members 10.

These threaded uprights are rotated by bottom bevel gear pairs 11 which, in turn, are driven through small shafts 12 entrained by other bevel gear pairs 13 intercoupled by a driven shaft 14.

The mentioned conveyor belt, in particular, is arranged on a vertical line of an operating board or floor member, thereon the operators can walk, indicated at 15 and arranged at the front of a bobbin bearing carriage 16 which is a portion of the bobbin frame, indicated overal at the reference number 17.

This bobbin bearing carriage 16, in turn, can slide with a parallel relationship with respect to its longitudinal axis, so as to be arranged, depending on the apparatus operating step, under the flyer bearing frame 18 or on said operating board.

The bobbin bearing carriage 16 is moreover provided with bobbin rotating devices 19 which are arranged on two rows and are evenly spaced, the number of said bobbin rotating devices 19 corresponding to a half of the number of the grippers associated with the endless conveyor belt 1, which conveyor belt is supported with empty tubes by means of known devices (not specifically shown).

During the operation of the apparatus, the single bobbins 20 are formed on the carriage 16 and then said carriage 16 is lowered so as to disengage the formed bobbins from the flyers 21. Then the carriage is caused to slide in parallel to its longitudinal axis, that is in a cross direction of the apparatus, to reach the operating board 15.

Then the conveyor belt is lowered so as to engage its gripping devices in the inside portions of the bobbins, said conveyor belt being successively raised again so as to disengage the bobbin rotating devices.

During the subsequent operating step, the conveyor belt is caused to slide for a distance equal to the distance of two gripping devices so as to locate its gripping devices, therewith empty tubes are engaged, on the vertical line of the empty bobbin rotating devices.

Then the conveyor belt will be lowered again, so as to arrange the empty tubes on the bobbin rotating devices of the carriage 15 which, as it is brought under the flyer bearing frame 18, will cause a new bobbin forming cycle to start.

Finally, the conveyor belt will be brought again to a raised position so as to doff the formed bobbins and load other empty tubes.

From the above disclosure it should be apparent that the invention fully achieves the intended objects.

While the invention has been disclosed and illustrated with reference to a preferred embodiment thereof, it should be apparent that the disclosed embodiment is susceptible to many modifications and variations all of which will come within the spirit and scope of the appended claims.

I claim:

1. An apparatus for doffing bobbins from a roving frame and for replacing doffed bobbins with empty tubes comprising an endless conveyor belt mounted for movement parallel to the longitudinal extent of said roving frame, a horizontal frame supporting said conveyor belt for vertical displacement relative to said roving frame, a bobbin bearing carriage mounted for movement transverse to the longitudinal extent of said roving frame, said conveyor belt cooperating with said carriage so as to remove full bobbins therefrom and arrange empty tubes thereon, said conveyor belt including two parallel legs coupled by semicircular portions and having evenly spaced gripping devices for engaging doffed bobbins and empty tubes, said tubes having respective bottom flanges, a pair of brackets supporting said horizontal frame and vertical guides mounting said brackets for vertical sliding movement.

2. An apparatus according to claim 1 further comprising threaded uprights supporting said brackets, bottom bevel gear pairs for rotatively driving said threaded uprights and further bevel gear pairs for driving said bottom bevel gear pairs.

3. An apparatus according to claim 1 further comprising an operating board mounted below said conveyor belt and located at a front portion of said carriage, and a flyer bearing frame on said roving frame, said carriage being displaceable beneath said flyer bearing frame.

4. An apparatus according to claim 3 wherein said carriage is provided with bobbin rotating devices arranged in two evenly spaced rows provided in a number corresponding to one half of that of said gripping devices of said conveyor belt.

* * * * *